US005992271A

United States Patent [19]

Mehlau et al.

[11] Patent Number: 5,992,271

[45] Date of Patent: Nov. 30, 1999

[54] ENGINEERS WRENCH

[75] Inventors: Hans Joachim Mehlau, Solingen; Klaus Neuhaus, Wuppertal, both of Germany

[73] Assignee: Eduard Wille GmbH & Co., Wuppertal, Germany

[21] Appl. No.: 08/957,815

[22] Filed: Oct. 27, 1997

[30] Foreign Application Priority Data

Oct. 30, 1996 [DE] Germany ..... 296 19 599

[51] Int. Cl.[6] ..... B25B 13/02

[52] U.S. Cl. ..... 81/119; 81/186

[58] Field of Search ..... 81/119, 186

[56] References Cited

U.S. PATENT DOCUMENTS

| | | | |
|---|---|---|---|
| 3,242,775 | 3/1966 | Hinkle . | |
| 3,785,226 | 1/1974 | Ward . | |
| 3,921,476 | 11/1975 | Evans . | |
| 4,765,211 | 8/1988 | Colvin | 81/119 |
| 5,381,710 | 1/1995 | Baker | 81/119 X |
| 5,396,820 | 3/1995 | Baker . | |
| 5,406,868 | 4/1995 | Foster | 81/119 |

FOREIGN PATENT DOCUMENTS

| | | |
|---|---|---|
| 770 360 | 9/1934 | France . |
| 2 143 814 | 6/1972 | France . |
| 808 697 | 7/1951 | Germany . |
| 196 34 209 | 8/1996 | Germany . |
| WO 94/23902 | 10/1994 | WIPO . |

*Primary Examiner*—James G. Smith
*Attorney, Agent, or Firm*—McDermott, Will & Emery

[57] ABSTRACT

An engineers wrench has at least one open end forming a mouth which defines a mouth opening. The mouth opening is laterally delimited by a pair of mutually oppositely disposed lateral, surfaces which define a wrench width. At least inwardly disposed sections of the lateral surfaces have a slight convex-cylindrical curvature defined by a finite radius of curvature so that the mouth opening widens in the direction towards respective outer edges to a mouth width which exceeds the wrench width. The mouth opening is inwardly delimited by a mouth base; two substantially flat surfaces are interconnected at the mouth base as well as connected to associated ones of the lateral surfaces through respective connecting surfaces. The connecting surfaces have a concave-cylindrical curvature defined by a smaller radius of curvature than the finite radius of curvature of the convex-cylindrically curved lateral surfaces.

9 Claims, 3 Drawing Sheets

ENGINEERS WRENCH

BACKGROUND OF THE INVENTION

The present invention relates to a new and improved construction of an engineers wrench. Such wrench is a tool for tightening or loosening threaded joints and engages, during such process, a polygonal or multi-edged member of the threaded joint like, for example, the hexagonal or square head of a screw or a hexagonal nut. The wrench typically comprises a shaft and either at one or both of its ends a recess which is open on one side and defines the mouth of the wrench. The mouth is laterally delimited by two mutually oppositely disposed lateral surfaces at a spacing which defines a wrench width across the lateral surfaces. The wrench width is slightly wider than the diametral spacing between mutually opposed surfaces of the polygonal or multi-edged member of the threaded joint to be engaged by the wrench.

The two lateral surfaces of conventional wrenches like the associated surfaces of the multi-edged member to be engaged by the wrench, are mutually parallel flat surfaces. Due to the slight clearance existing between the lateral surfaces laterally delimiting the mouth opening of the wrench and the associated surfaces of the polygonal or multi-edged threaded joint member onto which the wrench is placed, the wrench will be tilted relative to the threaded joint member by a small amount during tightening or loosening of the threaded joint. As a result, the lateral surfaces of the wrench engage the edges of the threaded joint member, particularly the inner edge with respect to the mouth opening on one side and the outer edge with respect to the mouth opening on the opposite side. The torque for tightening or loosening the threaded joint, then, is transmitted via the edges.

During such operation, high surface pressures occur at the edges. Particularly upon repeated tightening and loosening of the threaded joint member, these high surface pressures will lead to wear at the respective edges whereby the function of the members will be negatively affected during the course of time.

The invention specifically relates to an engineers wrench which engages not the edges but the lateral surfaces of the polygonal or multi-edged member of the threaded joint.

Various constructions are known to realize such engagement.

German Patent No. 231,581 relates to a wrench in which the engagement surfaces of the jaws, i.e. the lateral surfaces delimiting the mouth opening, are formed by two flat surface portions which adjoin each other in a roof-like manner. Edges are formed between the surface portions and face each other. Outer surface portions of each one of the two lateral surfaces are disposed at a spacing, which corresponds to the wrench width, from inner surface portions of each one of the two mutually opposite lateral surfaces. Also in this wrench construction, the lateral surfaces delimiting the mouth opening press onto the edges of the polygonal or multi-edged member of the threaded joint during torque transmission.

German Patent No. 697,361 shows a wrench having a mouth opening which is delimited by flat surfaces and which is substantially adapted to the shape of a hexagonal nut. All of the corners of the mouth opening define cylindrical recesses. By virtue thereof, the wrench is intended to engage the nut only outside of the corners of the nut. Line contact of an edge will cause notching.

International Published Patent Applications Nos. 93/10945 and 94/23902 show a wrench in which the lateral surfaces delimiting the mouth opening initially, i.e. adjacent the outer edges which define the mouth opening, comprise respective mutually parallel flat surface portions. Adjoined thereto in the lateral surfaces, are disposed respective indentations which, in turn, are adjoined by convex-cylindrical sections. The convex-cylindrical sections, then, continuously merge with an arcuate mouth base. The radii of curvature of the convex-cylindrical sections are equal to half the wrench width. High surface pressures result also in this construction due to the small radii of curvature.

German Published Patent No. 1,088,437 shows a wrench in which protrusions are formed in the mouth opening which only engage the lateral surfaces of screw heads or nuts.

SUMMARY OF THE INVENTION

Therefore, with the foregoing in mind, it is the primary object of the present invention to provide a new and improved construction of a wrench which is not afflicted with the drawbacks and limitations of the prior art heretofore discussed.

Another and more specific object of the invention is directed to a new and improved construction of a wrench which engages and acts upon the lateral surfaces of a polygonal or multi-edged threaded joint member at significantly reduced surface pressures.

Another and highly important object of the invention is directed to providing a new and improved construction of a wrench which ensures that the members of a threaded joint are not damaged upon application and operation of the wrench.

An important object of the invention resides in providing a new and improved wrench which is of comparatively simple construction and readily placed onto a polygonal or multi-edged member of a threaded joint.

Now, in order to implement these and still further objects of the invention, which will become more readily apparent as the description proceeds, the wrench according to the present development is manifested by the features that the mouth opening is laterally delimited by a pair of mutually oppositely disposed lateral surfaces which are slightly convexly curved at least at their inner sections at a finite radius of curvature. The lateral surfaces define a mouth opening which widens towards respective outer edges to a width exceeding the wrench width. The mouth opening is inwardly delimited by a mouth base; connecting surfaces interconnect the mouth base and respective ones of the lateral surfaces. The connecting surfaces are of concave cylindrical curvature having a smaller radius of curvature than the lateral surfaces.

The inventive wrench thus can be readily placed upon a polygonal or multi-edged member of a threaded joint like a screw head or nut by virtue of the widening mouth opening. When applying torque, the slightly convex-cylindrically curved lateral surfaces which laterally delimit the mouth opening, enter into engagement with the lateral surfaces and not with the edges of the particular threaded joint member. The engagement locations are mutually offset from each other in the direction of the symmetry line of the mouth opening. Therefore, a pair of forces acts upon the polygonal or multi-edged threaded joint member. The edges of the threaded joint member are located in the region of the concave-cylindrically curved connecting surfaces so that these edges remain free from loads. Still, the shape of the inventive wrench is comparatively very simple and hardly differs from a conventionally constructed wrench at first glance.

BRIEF DESCRIPTION OF THE DRAWINGS

The invention will be better understood and objects other than those set forth above, will become apparent when consideration is given to the following detailed description thereof. Such description makes reference to the annexed drawings wherein the same or analogous components are designated by the same reference numerals and wherein.

DETAILED DESCRIPTION OF THE PREFERRED EMBODIMENTS

Figure 1:
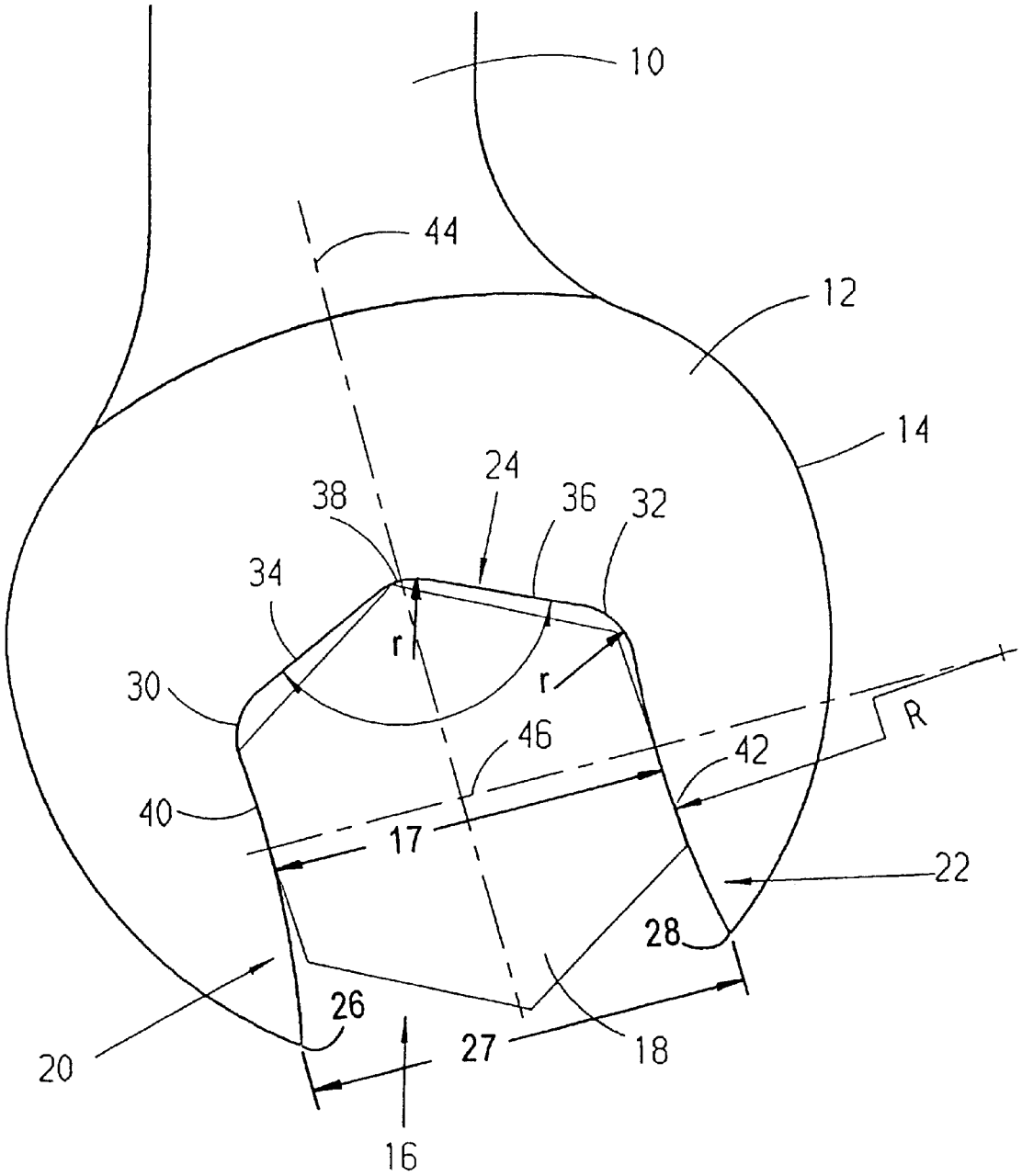
FIG. 1 is a top plan view of one end of an exemplary embodiment of the inventive wrench and an associated hexagonal threaded joint member.

Describing now the drawings, it will be understood that only enough of the construction of the inventive wrench has been shown as needed for those skilled in the art to readily understand the underlying principles and concepts of the present development while simplifying the showing of the drawings. While only a wrench mouth opening is shown in the drawings in its relationship with a hexagonal threaded joint member, it should be noted that the inventive wrench may have such mouth opening at each one of its ends or only at one of its ends. Also, it will be understood that the threaded joint member may be of square or any other polygonal or multi-edged configuration suitable to be acted upon by the inventive wrench and may constitute a screw head or nut or any other threaded joint member to be engaged by a wrench.

With reference to FIG. 1, there is schematically shown in top plan view a first exemplary embodiment of the inventive wrench, particularly an end thereof which is engaged with a hexagonal threaded joint member like, for example, a hexagonal screw head or hexagonal nut. The wrench comprises a shaft 10 having wrench heads 12 of identical or different construction at its opposite ends. The outer contour 14 of the wrench head 12 is similar to the outer contour of conventional wrenches. The illustrated end of the wrench head 12 includes a mouth opening 16 which defines a wrench width 17. The wrench can be placed thereby onto a polygonal or multi-edged threaded joint member like a screw head or nut, for example, a hexagonal screw head 18 of the type as shown in FIG. 1.

The mouth opening 16 is laterally delimited by two oppositely disposed lateral surfaces 20 and 22 and inwardly by a mouth base 24. The lateral surfaces 20,22 are of a slightly arcuate, convex-cylindrical configuration which is determined by a finite radius of curvature R. The thus convex-cylindrically curved lateral surfaces 20,22 extend towards respective outer edges 26 and 28 and define a mouth width 27 of the mouth opening 16. The arcuate convex-cylindrically curved lateral surfaces 20,22 in the inventive wrench construction, therefore, are not adjoined by parallel flat surface portions which is in contrast with the conventional wrench construction as known from the aforementioned International Published Patent Application No. WO 94/23902.

The arcuate, convex-cylindrically curved lateral surfaces 20,22 are connected to the mouth base 24 through respective concave-cylindrically curved connecting surfaces 30,32 which have a comparatively smaller radius of curvature r than the convex-cylindrically curved lateral surfaces 20,22. The concave-cylindrically curved connecting surfaces 30,32 tangentially merge with the respective lateral surfaces 20,22 and the mouth base 24.

The mouth base 24 is substantially V-shaped in cross-section and has two substantially flat surfaces 34,36 which respectively adjoin the connecting surfaces 30,32. Therein, the planes defined by the two substantially flat surfaces 34,36 enclose an obtuse angle of more than 120°. Preferably, the obtuse angle between the two substantially flat surfaces 34,36 is in the range of 125° to 150°. In the illustrated, preferred exemplary embodiment the angle between the two substantially flat surfaces 34,36 is substantially equal to 130°. The two substantially flat surfaces 34,36 are interconnnected by a concave-cylindrically curved connecting surface 38.

The finite radius of curvature R of the convex-cylindrically curved lateral surfaces 20,22 is greater than the wrench width 17 but smaller than the quintuple of such wrench width 17. In the illustrated preferred exemplary embodiment the radius of curvature R of the lateral surfaces 20,22 approximately corresponds to the 2.5-fold measure of the wrench width 17.

The radii of curvature r of the concave-cylindrically curved connecting surfaces 30,32, which are respectively formed between the lateral surfaces 20,22 and the two substantially flat surfaces 34,36, as well as the concave-cylindrical connecting surface 38, which is formed between the mouth base 38 and the two substantially flat surfaces 34,36, have a value which is in the range of the 0.08-fold to the 0.3-fold measure of the wrench width 17. In the illustrated preferred exemplary embodiment such radii of curvature r amount to approximately the 0.16-fold measure of the wrench width 17.

The shape of the aforedescribed inventive wrench is quite simple. The mouth opening 16 widens towards the exterior so that the inventive wrench can be readily placed onto a polygonal or multi-edged threaded joint member like a screw head or nut. When applying a torque in clockwise direction, the slightly arcuate convex-cylindrically curved lateral surfaces 20,22 engage corresponding flat lateral surfaces of the screw head or nut, as the case may be. The mouth opening 16 defines a line of symmetry 44 and, as a result, the locations of engagement 40,42 therein are mutually offset relative to each other along such line of symmetry 44. Upon application of torque to the wrench, a pair of forces will act upon the threaded joint member about its axis 46. By virtue of the relatively slight convex-cylindrical curvature of the lateral surfaces 20,22, the resulting surface pressures will be fairly small. Consequently, there is no load applied to the edges of the threaded joint member, i.e. the hexagonal screw head 18 shown in FIG. 1.

The aforedescribed V-shaped design of the mouth base 24 in which the two substantially flat surfaces 34,36 enclose an angle somewhat greater than 120°, has the advantage over prior art wrenches that, while the outer contour 14 of the wrench head 12 is practically the same, more of the wrench material is retained in the jaws of the inventive wrench as compared to the conventional arcuate mouth base. Due to the fact that the angle enclosed by the V-shape is greater than 120°, there is further ensured that the corners or adjoining surfaces of the threaded joint member do not engage the mouth base 24 or the concave-cylindrically curved connecting surfaces 30,32 in a way that might lead to jamming and uncontrolled loads. The radii of curvature r of the connecting surfaces 30,32 and 38 are selected such that the material will not crack at these locations even under the action of high torques.

Figure 2:
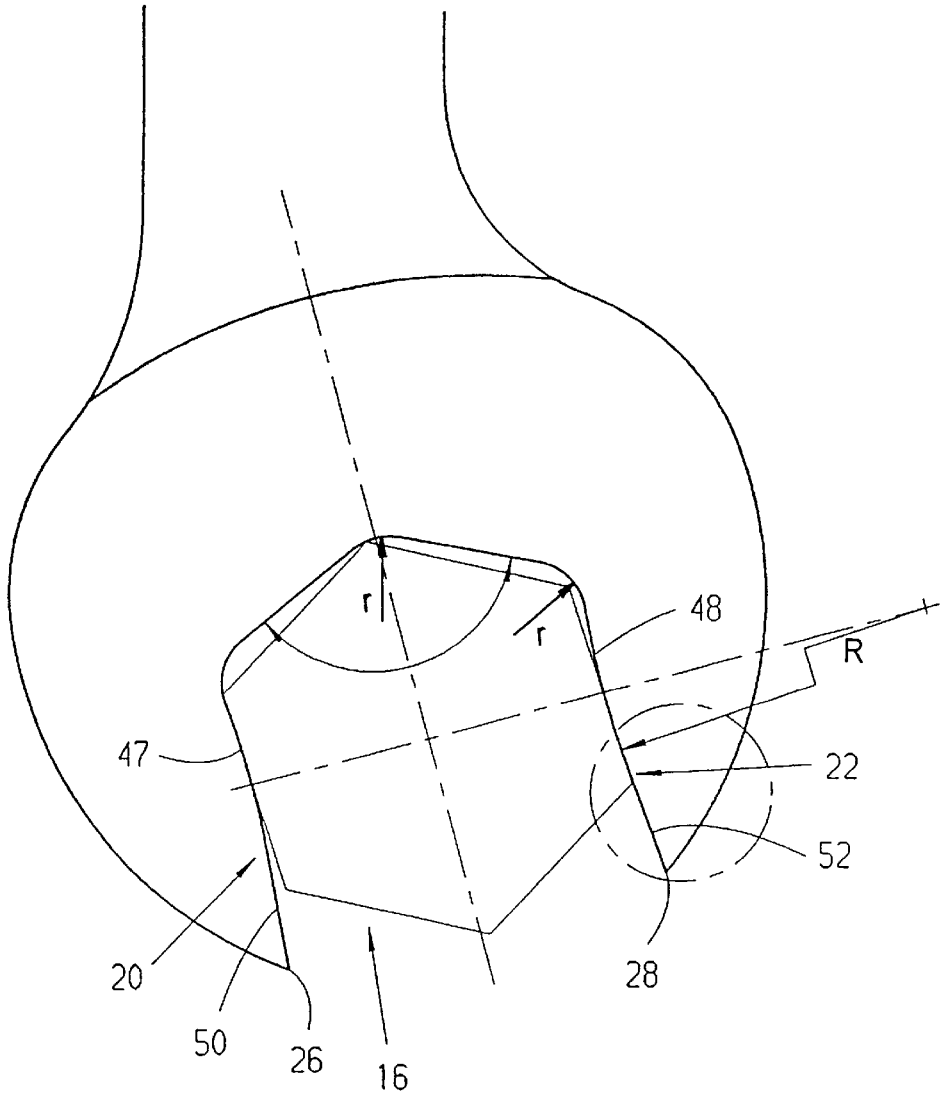
FIG. 2 shows one end of a modified embodiment the inventive wrench and an associated hexagonal threaded joint member in a view similar to FIG. 1.
Figure 3:
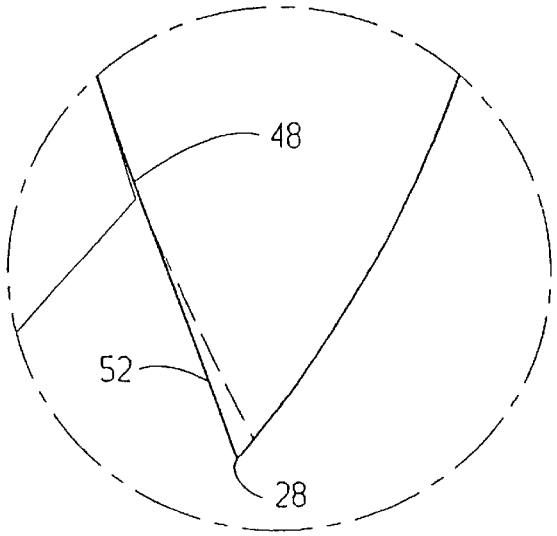
FIG. 3 shows a detail of FIG. 2.

In the modified exemplary embodiment of the inventive wrench as shown in FIGS. 2 and 3, slightly convex-cylindrically curved inwardly disposed surface portions 47,48 of the lateral surfaces 20,22 do not extend up to the respective outer edges 26,28 of the mouth opening 16. In fact, the inwardly disposed, convex-cylindrically curved surface portions 47,48 are respectively adjoined by outwardly disposed substantially flat surface portions 50,52. The substantially flat surface portions 50,52 extend tangentially to the respectively adjoining convex-cylindrically curved surface portions 47,48. The slightly convex-cylindrically curved inwardly disposed surface portions 47,48 and the respectively adjoining substantially flat surface portions 50,52 define, in the same manner as in the exemplary embodiment shown in FIG. 1, a mouth opening 16 which widens towards the respective outer edges 26,28 to a mouth width of a measure exceeding the wrench width of the mouth opening 16.

Instead of merging tangentially, and as shown in FIG. 3, the outwardly disposed flat surface portions 50,52 may adjoin the respective inwardly disposed slightly convex-cylindrically curved surface portions 47,48 at an angle in an outward direction such that an obtuse edge is respectively formed on the outside between the surface portions 50,47 and 52,48.

Figure 4:
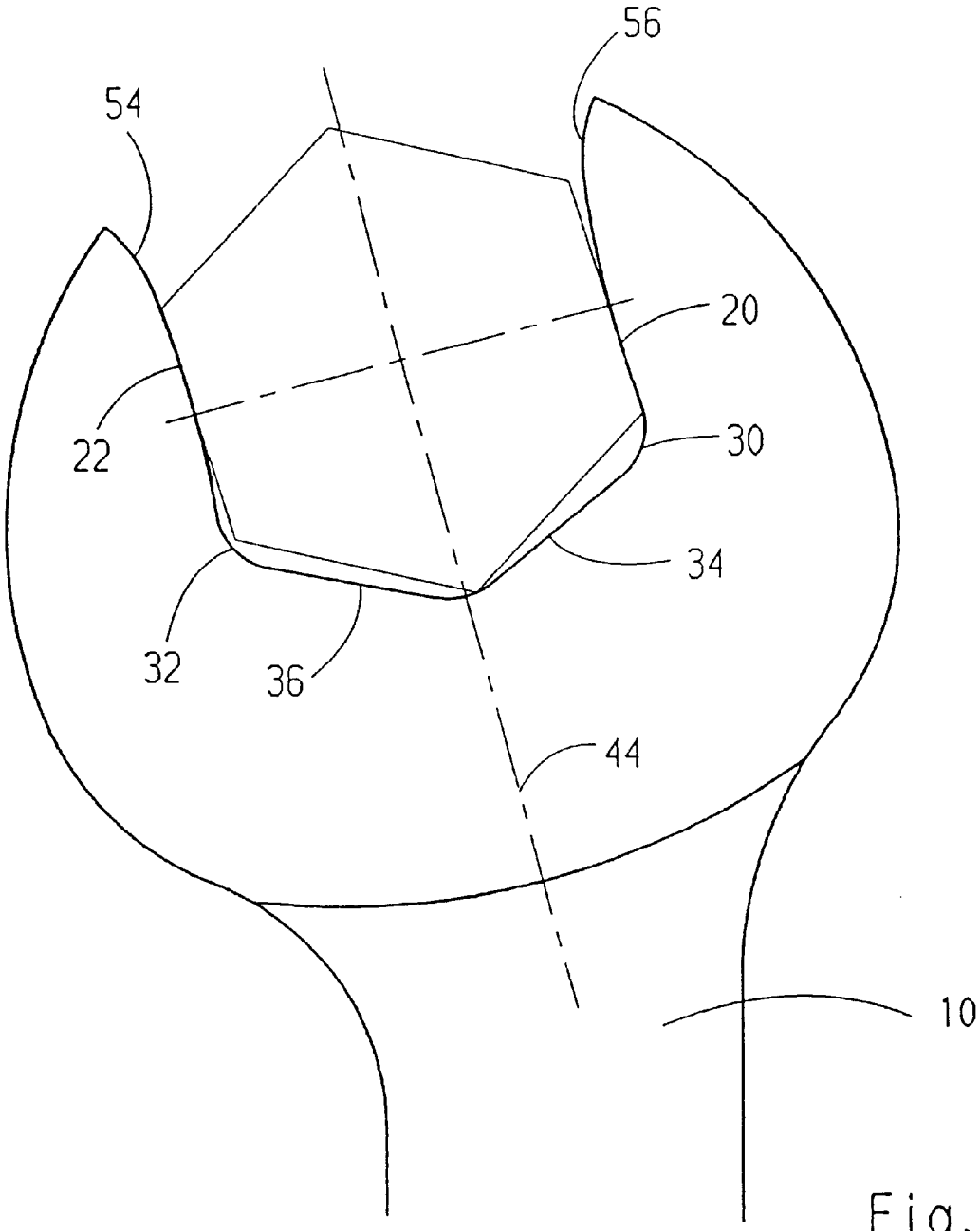
FIG. 4 is a top plan view of one end of a further exemplary embodiment of the inventive wrench and an associated hexagonal threaded joint member.

A further exemplary embodiment of the inventive wrench is illustrated in FIG. 4 in a manner similar to FIGS. 1 and 2. In this embodiment, the slightly convex-cylindrically curved inwardly disposed surfaces 20,22 are adjoined by respective otwardly disposed convex-cylindrically curved surface portions 56,54 which have a radius of curvature which is substantially smaller than the radius of curvature R of the convex-cylindrically curved lateral surfaces shown in FIG. 1. The surface portions 54,56 delimit a continuously widening mouth opening which guides the wrench during its placement onto a threaded joint member like, for example, a screw head or nut.

Otherwise, the exemplary embodiments of the inventive wrench as shown in FIG. 2 to 4 are constructed substantially in the same manner as the exemplary embodiment of the inventive wrench as shown in FIG. 1.

While there are shown and described present preferred embodiments of the invention, it is to be distinctly understood that the invention is not limited thereto, but may be otherwise variously embodied and practiced within the scope of the following claims. Accordingly

What we claim is:

1. A wrench having an open-yawed head, said head having two opposed lateral surfaces facing each other and a mouth base, said opposed surfaces and mouth base defining a mouth therebetween for engaging a polygonal nut or bolt head, said mouth having a mouth opening between said opposed surfaces at outer edges of said opposed surfaces distal from said mouth base;

wherein said opposed lateral surfaces, at least at inner sections adjacent to said mouth base, are convex-cylindrically curved with a finite radius of curvature, said mouth widening continuously from a narrowest cross section between said convex inner sections to said outer edges, and defining a wrench width at said narrowest cross-section;

said mouth base having a substantially v-shaped configuration comprising two substantially flat surfaces defining respective planes which form an obtuse angle greater than about 120°;

said mouth further comprising first concave-cylindrical connecting surfaces having first radii of curvature and connecting said convex-cylindrical opposed surfaces and said flat surfaces of said mouth base, and comprising a second concave cylindrical connecting surface having a second radius of curvature and interconnecting said flat surfaces, said radii of curvature of said first and second connecting surfaces being substantially smaller than said finite radius of curvature of said convex-cylindrical opposed surfaces.

2. The wrench as defined in claim 1, wherein said convex-cylindrically curved opposed surfaces terminate at the outer edges to define a mouth width which exceeds said wrench width.

3. The wrench as defined in claim 1, wherein said first concave-cylindrical connecting surfaces tangentially merge with said convex-cylindrically curved opposed surfaces.

4. The wrench as defined in claim 1, wherein said obtuse angle has a value in the range of 125 to 150 degrees.

5. The wrench as defined in claim 4, wherein said obtuse angle is substantially equal to 130 degrees.

6. The wrench as defined in claim 1, wherein said finite radius of curvature of said convex-cylindrically curved opposed surfaces is greater than said wrench width but smaller than the qintuple of said wrench width.

7. The wrench as defined in claim 6, wherein said finite radius of curvature is substantially 2.5 times said wrench width.

8. The wrench as defined in claim 1, wherein said first radii of curvature of said first concave-cylindrical connecting surfaces have a value in the range of about 0.08 times to about 0.3 times said wrench width.

9. The wrench as defined in claim 8, wherein said first radii of curvature are substantially 0.16 times said wrench width.

* * * * *